US007857616B2

(12) United States Patent
Carbone et al.

(10) Patent No.: US 7,857,616 B2
(45) Date of Patent: Dec. 28, 2010

(54) BURNER APPARATUS

(75) Inventors: Philip C. Carbone, North Reading, MA (US); Matthew E. Brekken, Arlington, MA (US); Peter F. Pescatore, Wakefield, MA (US); Charles E. Marble, Bridgewater, MA (US); Matthew Rhodes, Stevensville, MI (US)

(73) Assignee: TIAX LLC, Lexington, MA (US)

( * ) Notice: Subject to any disclaimer, the term of this patent is extended or adjusted under 35 U.S.C. 154(b) by 653 days.

(21) Appl. No.: 11/100,332

(22) Filed: Apr. 6, 2005

(65) Prior Publication Data

US 2005/0250065 A1 Nov. 10, 2005

Related U.S. Application Data

(60) Provisional application No. 60/559,830, filed on Apr. 6, 2004.

(51) Int. Cl.
*F23D 3/40* (2006.01)

(52) U.S. Cl. ..... 431/7; 431/170; 431/328; 431/354

(58) Field of Classification Search ..... 431/7, 431/170, 328, 329, 326, 346, 354
See application file for complete search history.

(56) References Cited

U.S. PATENT DOCUMENTS

| | | | | |
|---|---|---|---|---|
| 1,368,120 | A * | 2/1921 | Cole | 239/553.3 |
| 3,681,002 | A * | 8/1972 | Weller et al. | 431/268 |
| 3,947,227 | A * | 3/1976 | Granger et al. | 431/118 |
| 4,025,281 | A | 5/1977 | Lapp | |
| 4,608,012 | A | 8/1986 | Cooper | |
| 5,017,129 | A | 5/1991 | Velie et al. | |
| 5,139,417 | A | 8/1992 | Ghassemzadeh | |
| 5,356,487 | A | 10/1994 | Goldstein et al. | |
| 5,375,998 | A * | 12/1994 | Witteveen | 431/328 |
| 5,408,984 | A | 4/1995 | Maughan | |
| 5,488,942 | A | 2/1996 | Maughan | |
| 5,511,974 | A | 4/1996 | Gordon et al. | |
| 5,522,723 | A | 6/1996 | Durst et al. | |
| 5,624,252 | A | 4/1997 | Charles, Sr. et al. | |
| 5,667,374 | A * | 9/1997 | Nutcher et al. | 431/7 |
| 5,782,629 | A | 7/1998 | Lannutti | |

(Continued)

FOREIGN PATENT DOCUMENTS

| | | |
|---|---|---|
| CH | 399 697 | 9/1965 |

(Continued)

OTHER PUBLICATIONS

K. Boomsma, "Metal Foams as Novel Compact High Performance Heat Exchangers for the Cooling of Electronics," a dissertation submitted to the Swiss Federal Institute of Technology Zurich, 2002.

(Continued)

*Primary Examiner*—Alfred Basichas
(74) *Attorney, Agent, or Firm*—Karen B. King

(57) ABSTRACT

A burner apparatus utilizes a reticulated member to promote mixing of a fuel and oxidizer mixture. A plurality of exit ports, disposed on a wall or surface encapsulating the reticulated member, defines exit streams of the mixture that produces flames upon combustion. The burner apparatus have high heating rates and turndown ratios of at least about 18:1.

34 Claims, 6 Drawing Sheets

U.S. PATENT DOCUMENTS

| | | | |
|---|---|---|---|
| 5,791,893 | A | 8/1998 | Charles, Sr. et al. |
| 5,800,156 | A | 9/1998 | Kahlke et al. |
| 5,800,159 | A | 9/1998 | Maughan et al. |
| 5,899,681 | A | 5/1999 | Maughan |
| 5,915,956 | A | 6/1999 | Kwiatek et al. |
| 6,017,211 | A | 1/2000 | Gort et al. |
| 6,030,206 | A | 2/2000 | Shizukuisha et al. |
| 6,065,962 | A | 5/2000 | Shizukuisha et al. |
| 6,095,800 | A | 8/2000 | Shizukuisha et al. |
| 6,095,802 | A | 8/2000 | Kwiatek |
| 6,244,263 | B1 | 6/2001 | Schlosser et al. |
| 6,299,436 | B1 | 10/2001 | Huang |
| 6,328,556 | B1 | 12/2001 | Sömer |
| 6,354,831 | B1 | 3/2002 | Wilk, Jr. et al. |
| 6,758,206 | B1 | 7/2004 | Barnes et al. |
| 6,830,045 | B2 | 12/2004 | Brock et al. |
| 6,851,420 | B2 | 2/2005 | Jennings |
| 2002/0164553 | A1 | 11/2002 | Distaso et al. |
| 2003/0054313 | A1 | 3/2003 | Rattner et al. |

FOREIGN PATENT DOCUMENTS

| | | |
|---|---|---|
| EP | 0 194 157 | 9/1986 |
| EP | 0 415 008 A1 | 3/1991 |
| EP | 0 593 121 | 4/1994 |
| GB | 1262334 | 2/1972 |
| GB | 1602196 | 11/1981 |
| JP | 61-256113 | 11/1986 |
| WO | WO 84/01992 | 5/1984 |

OTHER PUBLICATIONS

K. Butcher et al., "Compact Heat Exchangers Incorporating Reticulated Metal Foam," Data Sheet, Porvair Fuel Cell Technology, publication date unknown.

S. Crosnier et al., "Modelling of Gas Flow Through Metallic Foams," pp. 1-15, Grenoble, France (publication date unknown).

D. Floyd, "Pressure Drop and Velocity Distribution in FeCrAlY Metal Foam—Metal Foam Characterization," Oct. 13, 2000, Porvair Fuel Cell Technology.

D. Haack et al., "Novel Lightweight Metal Foam Heat Exchangers," published at www.porvairmetalfoam.com/papers/Mech%20engineer%20congress%20paper.pdf;, publication date unknown, pp. 1-7, Porvair Fuel Cell Technology, Inc., Hendersonville, NC, USA and Department of Engineering, University of Cambridge, Trumpington Street, Cambridge, UK.

J. Klett et al., "Modeling Convective Heat Transfer with Graphite Foams," Oak Ridge National Laboratory, Oak Ridge, TN (publication date unknown).

"MicroMass™ Material," Data Sheet, 1 sheet, Porvair Fuel Cell Technology, publication date unknown.

V. Paserin et al., "The chemical vapor deposition technique for Inco nickel foam production—manufacturing benefits and potential applications," pp. 1-9, Inco Technical Services Limited, Ontario, Canada and McMaster Centre for Automotive Materials, McMaster University, Ontario, Canada (publication date unknown).

"Porvair Advanced Materials—Metal Foam," Data Sheets from www.porvair.com, Porvair Advanced Materials, Inc., Hendersonville, NC, USA (publication date unknown).

Porvair Advanced Materials, "Ceramic Foam Standard Property & Performance Data," Data Sheets, Hendersonville, NC, publication date unknown.

D. Floyd, "Mechanical Properties of Open Cell Sintered Iron Based Porous Metal Structures—Experimental Results and Discussion," published at http://porvairmetalfoam.com/papers/Mech%20strength.pdf; Porvair Fuel Cell Technology, Jul. 2001.

* cited by examiner

BURNER APPARATUS

CROSS-REFERENCE TO RELATED APPLICATION

This application claims the benefit under 35 U.S.C. §119 to U.S. Provisional Patent Application Ser. No. 60/559,830, entitled COOKTOP BURNER WITH IMPROVED GAS DELIVERY, filed on Apr. 6, 2004, which is incorporated herein by reference in its entirety.

BACKGROUND OF THE INVENTION

1. Field of the Invention

The invention relates to burner apparatus and, in particular, to heating and/or cooking appliances having one or more gaseous fuel burner apparatus.

2. Description of Related Art

Granger et al., in U.S. Pat. No. 3,947,227 disclose burners having a metal foam burner element that holds liquid fuel by capillary action.

Goldstein et al., in U.S. Pat. No. 5,356,487, disclose a thermally amplified and stimulated emission radiator fiber matrix burner.

Cooper, in International Application Publication No. WO 84/01992 and U.S. Pat. No. 4,608,012, discloses a self-aerating radiant gas burner assembly comprising a mixing chamber closed except for an air inlet into which is directed a gas injector jet. The chamber is surmounted by a radiant burner element of ceramic foam.

Gordon et al., in U.S. Pat. No. 5,511,974, disclose a ceramic foam low emissions burner for natural gas-fired residential appliances.

Lannutti, in U.S. Pat. No. 5,782,629, discloses radiant burner surface and method of making same.

Kahlke et al., in U.S. Pat. No. 5,800,156, disclose a radiant burner with a gas-permeable burner plate.

Shizukuisha et al., in U.S. Pat. Nos. 6,030,206, 6,065,962, and 6,095,800, disclose a leak preventive structure for a case of a surface combustion burner.

Rattner et al., in U.S. Patent Application Publication No. 2003/0054313, disclose a radiator element composed of a metal foam for use within a radiant burner.

Herbert, in European Patent Application Publication EP 0 194 157, discloses a gas burner for use in a self aerating gas fire having an apertured or self-porous, solid, or bonded fiber distribution plate and a plaque of open-pore ceramic foam for surface combustion of said mixture.

SUMMARY OF THE INVENTION

In accordance with one or more embodiments, the invention relates to a burner comprising means for mixing fuel and oxidizer and a plurality of exit ports positioned downstream of the means for mixing and constructed and arranged to effect a minimum flow velocity of the mixture of fuel and oxidizer.

In accordance with one or more embodiments, the invention relates to a method of fabricating a burner comprising a plurality of exit ports sized to effect a minimum flow velocity of a fuel/air mixture therethrough. The method comprises an act of installing a reticulated member in a cavity of the burner.

In accordance with one or more embodiments, the invention relates to a burner comprising a fuel/air mixture inlet, a burner body fluidly connected to the fuel/air mixture inlet and comprising a peripheral wall having a plurality of exit ports defining a fuel/air mixture flow path, and a porous member disposed in the fuel/air mixture flow path.

BRIEF DESCRIPTION OF THE DRAWINGS

In the accompanying drawings, each identical or nearly identical component that is illustrated in the various figures is represented by a like numeral. For purposes of clarity, not every component may be labeled in every drawing.

In the drawings:

FIGS. 1A-1C are schematic illustrations showing various views of a burner apparatus in accordance with one or more embodiments of the invention, wherein FIG. 1A shows a front perspective view, FIG. 1B shows a rear perspective view, and FIG. 1C shows an elevational view of the burner apparatus;

FIGS. 2A-2B are schematic illustrations showing cross-sectional views of the burner apparatus illustrated in FIGS. 1A-1C, wherein FIG. 2A shows a side cross-section view and FIG. 2B shows a front cross-sectional view;

FIGS. 3A-3B are schematic illustrations of a component, comprising a plurality of exit ports, of a burner apparatus in accordance with one or more embodiments of the invention, wherein FIG. 3A shows a perspective view of the component and FIG. 3B shows an elevational view of the component;

FIG. 4A-4B are schematic illustrations of a burner apparatus in accordance with further embodiments of the invention, wherein FIG. 4A shows perspective view and FIG. 4B shows a perspective exploded view of the assembly;

DETAILED DESCRIPTION

Figure 1A:
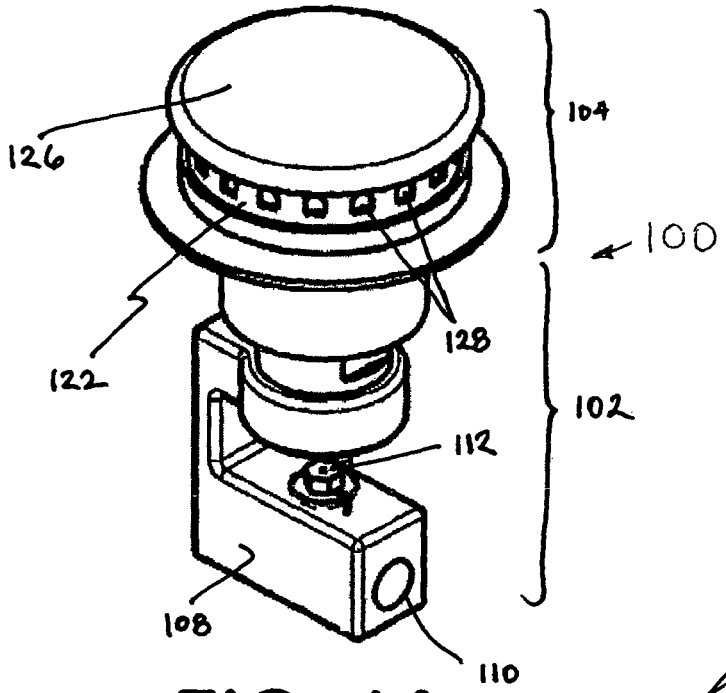
Figure 1B:
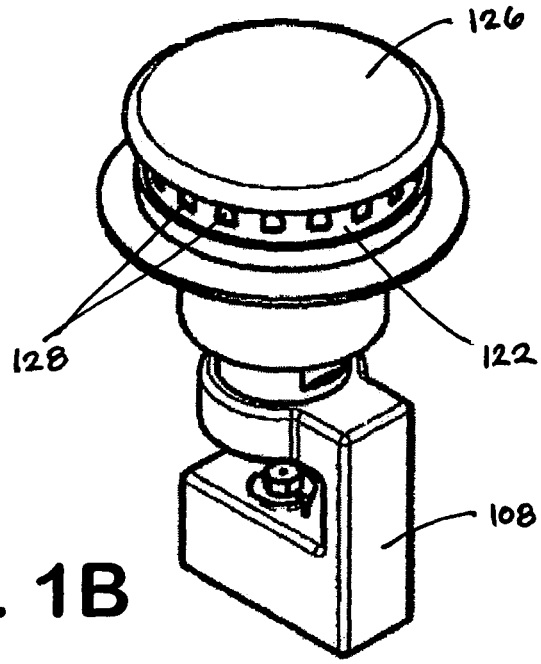
Figure 1C:
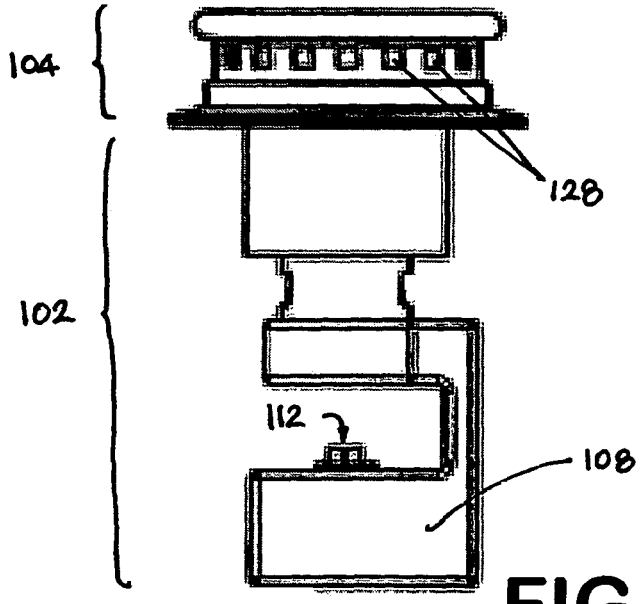

This invention is not limited in its application to the details of construction and the arrangement of components set forth in the following description or illustrated in the drawings. The invention is capable of other embodiments and of being practiced or of being carried out in various ways.

The invention is directed to burner assemblies or apparatus having high turndown ratios, low carbon monoxide (CO) emissions, and high efficiencies. The invention is further directed to compact, low profile burner apparatus providing high heating/firing rates (heat flux) and also having low firing rates thereby providing both accelerated heating and low maintainable heating. The invention provides burner assemblies having one or more components that facilitate fuel and oxidizer mixing as well as uniform distribution of the mixture to a plurality of burner ports. The burner apparatus can further comprise one or more components that prevent or at least inhibit flashback incidences while promoting reduced or no emissions of undesirable species during combustion use. The burner apparatus of the invention can be utilized in industrial, commercial, and even residential heating and/or cooking services.

The invention is further directed to naturally aspirated burner apparatus, free of any forced oxidizer assemblies.

In accordance with one or more embodiments, the burner apparatus of the invention can have a lower cross-sectional profile compared to conventional burner assemblies while providing an equivalent maximum firing rate. For example, a nominal 2-inch diameter burner apparatus of the invention can have a maximum firing rate of at least about 9,000 BTU/hr, and in some cases, at least about 12,700 BTU/hr while having a protrusion profile height of less than about 25.4 mm (about 1 inch), in some cases, less than about 19 mm (about 0.75 inch). The protrusion height is determined as a separation distance between a top surface of the burner assembly to an exposed surface upon which the burner is mounted. Thus in accordance with one or more embodiments of the invention, a burner apparatus of the invention, utilized, for example, in cooking appliances, can be mounted on a cooktop surface at a depth that provides a distance from a cooktop top surface of the burner assembly to the mounting surface of less than about 25.4 mm.

In accordance with further embodiments of the invention, the burner apparatus can have a high turndown ratio while, in some cases, also providing comparable or the same maximum firing rates relative to conventional burner apparatus. For example, a nominal 2-inch diameter burner apparatus of the invention can have a turndown ratio of at least about 15:1, in some cases, at least about 18.7:1, in still other cases, at least about 20:1, while providing a maximum firing rate of about 12,700 BTU/hr. Turndown ratio refers to the ratio of the maximum firing rate relative to the minimum firing rate that can be maintained by a burner apparatus. For example, the burner apparatus in accordance with one or more embodiments of the invention can operate at a maximum firing rate of about 12,700 BTU/hr to a minimum firing rate of about 640 BTU/hr corresponding to a turndown ratio of about 19.8:1. Thus, the burner apparatus of the invention can provide a high heating rate under a first operating condition and also provide a low heating rate under a second operating condition. The flexibility thereby provided by the burner apparatus of the invention reduces configuration complexity.

FIGS. 1A-1C and FIGS. 2A-2B schematically show a burner apparatus 100 in accordance with one or more embodiments of the invention. As exemplarily shown, burner apparatus 100 comprises a fuel inlet section 102 and a combustion section 104.

Fuel inlet section 102 comprises a fuel/oxidizer introduction component, exemplarily shown as a venturi assembly 106 disposed in a support or bracket 108. Venturi assembly 106 comprises a fuel inlet port 110, typically fluidly connected to a fuel source (not shown), and a fuel nozzle 112. Venturi assembly 106 further comprises a venturi body 114 disposed at a position downstream from fuel nozzle 112. Venturi body defines a venturi channel 116 which provides a conduit for passing a fuel and an oxidizer drawn therethrough. An exit end of channel 116 in venturi body 114 is fluidly connected to combustion section 104.

Combustion section 104 comprises a burner cavity 120 defined by a burner body. The burner body comprises a peripheral wall 122 and a burner mounting assembly 124. In accordance with one or more embodiments of the invention, burner body can further comprise a burner cap 126. In accordance with some embodiments of the invention, burner cap 126 can be unitarily formed with peripheral wall 122 as exemplarily shown in FIGS. 3A and 3B. In accordance with other embodiments of the invention, peripheral wall 122 can be formed as a portion of assembly 124. Combustion section 104 further comprises a plurality of exit ports 128 exemplarily shown as uniformly disposed in peripheral wall 122.

Figure 3A:
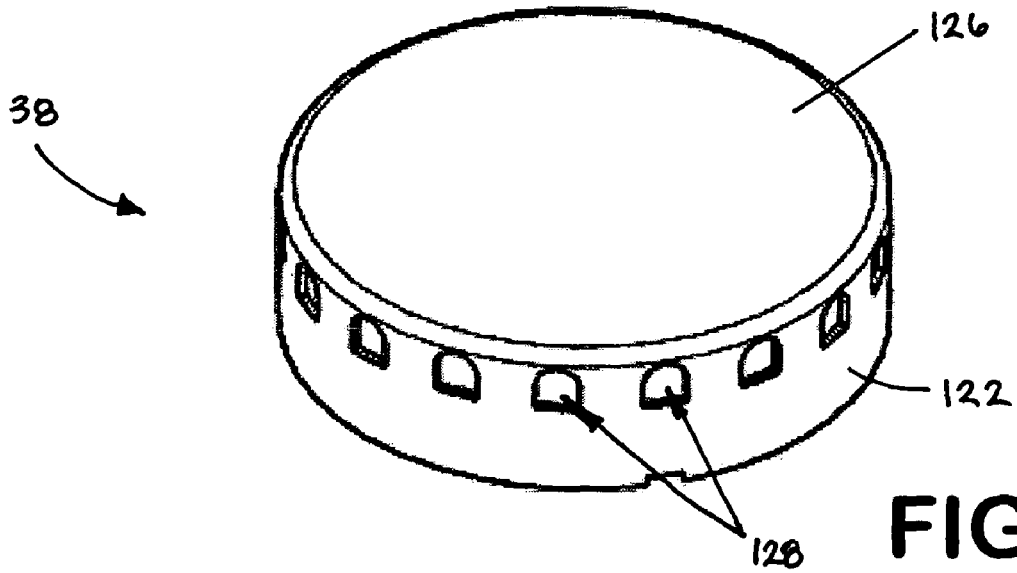
Figure 3B:
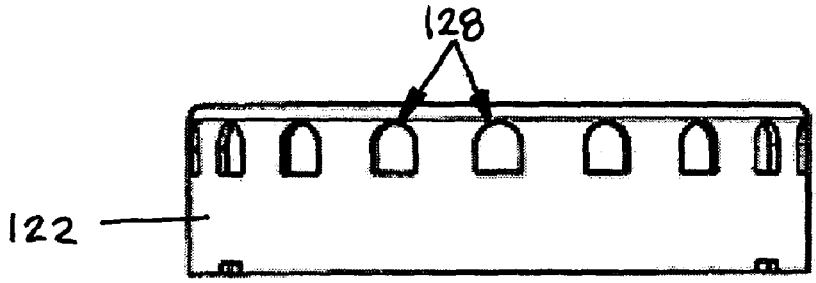
Figure 4B:
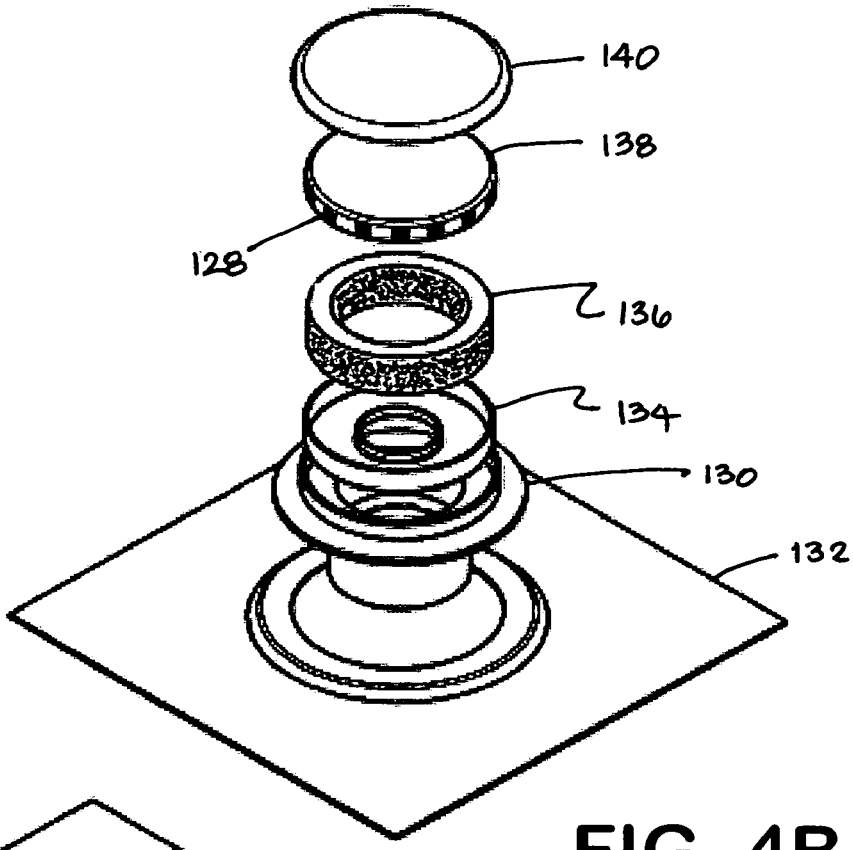
Figure 4A:
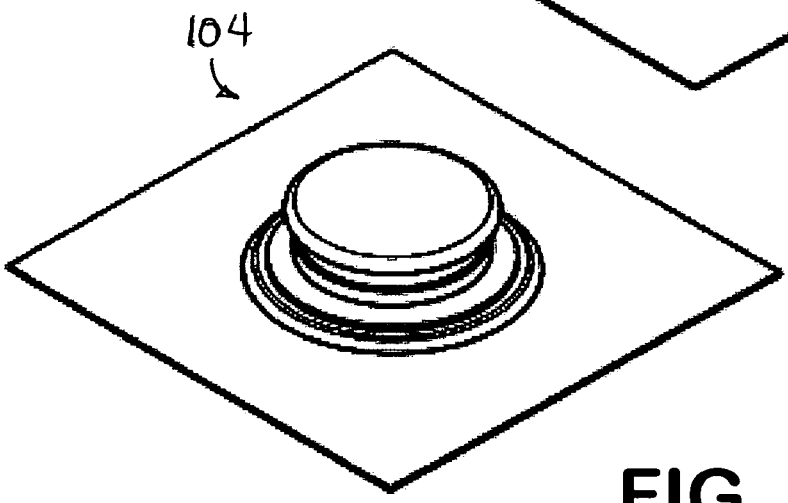

FIGS. 4A-4B exemplarily show combustion section 104 of a burner apparatus in accordance with further embodiments of the invention. In the exploded perspective view presented in FIG. 4B, combustion section 104 comprises a burner base 130 typically supported on a surface 132 of a cooking and/or a heating appliance (not shown). Combustion section 104 optionally comprises a burner bottom bracket 134 disposed, supported, and/or mounted on burner base 130. Combustion section 104 can also further comprise a mixing element 136, which is exemplarily shown as being formed as an annular body having a defined porosity. Combustion section 104 further comprises a case 138, also exemplarily shown in FIGS. 3A-3B, comprising peripheral wall 122 with a cover surface or cap 126 and a plurality of exit ports 128. The burner apparatus can optionally comprise a cover plate 140.

During operation of the burner apparatus, fuel is typically introduced from one or more fuel sources (not shown) through fuel inlet port 110 and injected into venturi body 114 through nozzle 112. A fuel stream is typically injected at a sufficient velocity to induce drawing an oxidizer into channel 116 to form a mixture of fuel and oxidizer. From the venturi body, the fuel/oxidizer mixture enters cavity 120. Cavity 120 typically serves to facilitate, at least partially, mixing of the fuel and oxidizer mixture. In some cases, cavity 120 can further facilitate distribution of the fuel/oxidizer mixture to at least one of the plurality of exit ports 128. For example, burner apparatus can be connected to a source of fuel, such as, but not limited to, natural gas and propane, and injected into channel through nozzle 112 thereby drawing air as an oxidizer to form a fuel/air mixture. The fuel/oxidizer mixture, e.g., natural gas/air mixture, enters cavity or chamber 120.

In accordance with one or more embodiments of the invention, mixing of the fuel and oxidizer mixture is further promoted by establishing a flow path from the fuel and oxidizer sources to through one or more mixing elements. In accordance with further embodiments of the invention, the flow path of the mixed fuel/oxidizer mixture involves a plurality of fuel/oxidizer streams exiting the burner apparatus through a plurality of exit ports. The plurality of streams can be ignited with one or more ignition sources and combust to form a flame pattern. The flame pattern serves as a heating source when placed in thermal communication with one or more cooking utensils. Thus, in accordance with one or more embodiments, the invention provides a burner apparatus comprising one or more flow paths from one or more fuel sources and one or more oxidizer sources through one or more mixing elements that promote or at least facilitates mixing of the fuel and oxidizer prior to exit thereof through one or more exit ports.

Element 136 typically promotes or facilitates mixing of the fuel and oxidizer mixture flowing therethrough. Mixing can be performed by creating a plurality of random flow paths therein. For example, the random flow paths can be created by introducing or passing the mixture through an element comprised of a porous member. In some cases, efficient mixing of the fuel and oxidizer can be effected by providing a plurality of baffles or impingement surfaces that orderly or randomly distributes the overall mixture. Thus, for example, a plurality of baffles can be disposed in element 136 that separates a plurality of portions of the mixture and randomly combines such plurality of portions. Element 136 can also reduce variability of flow rate of the mixture through the plurality of exit ports.

Figure 2B:
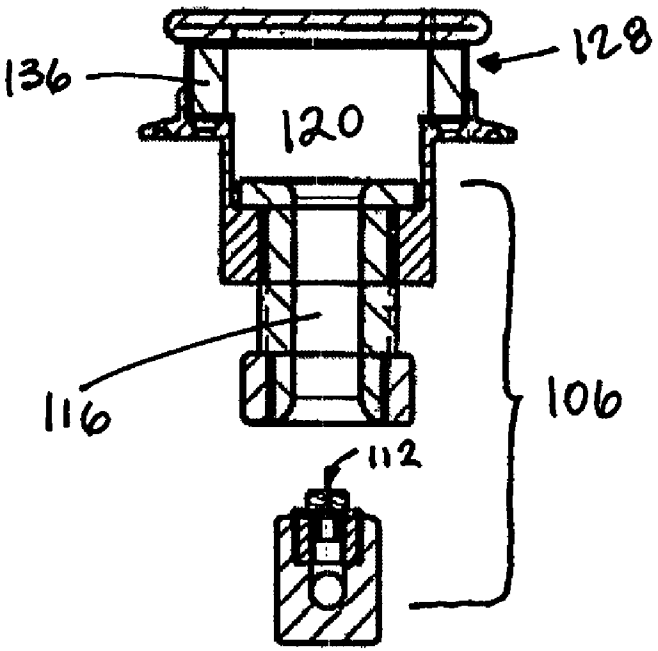
Figure 2A:
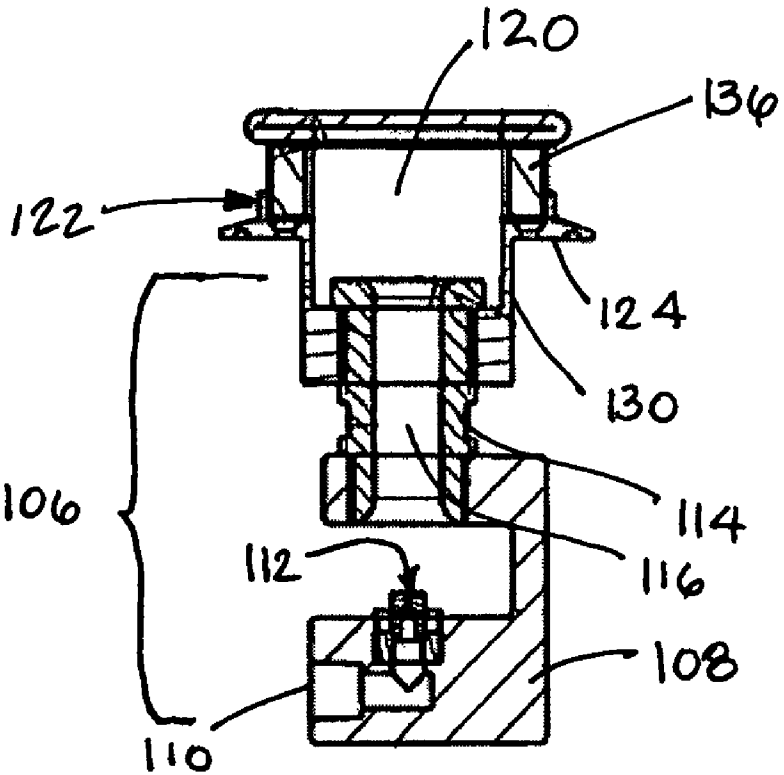

In accordance with one or more embodiments of the invention, element 136 can be shaped as an annular reticulated member as illustrated in FIGS. 2A, 2B and 4B. However, the porous or reticulated member can have any suitable shape that provides flashback prevention and/or mixing of fuel and oxidizer. The reticulated member typically has an open-cell structure that provides a plurality of flow paths for a fluid flowing through its body. The porous member typically also has a porosity, pore density, which provides the desired flashback prevention and/or mixing effects. For example, the porosity of the porous member can range from about 10 pores per inch to about 60 pores per inch (ppi). A porosity of less than 10 ppi provides decreased flow resistance but may increase the propensity for flashback for combustion processes typically associated with residential cooking operations. A porosity of greater than about 60 ppi can provide less mixing efficiency of the fuel and oxidizer mixture thereby increasing the likelihood of unacceptable or undesirable species generation, such as, but not limited to, carbon monoxide, during combustion processes typically associated with residential cooking operations. The flow path length traversed by the mixture of fuel and oxidizer, from a first or entering surface or end to a second or exiting surface or end of element 136 can be adjusted to utilize lower or higher pore densities. For example, a reticulated member having a high pore density, e.g. more than about 40 ppi, can result in a pressure loss per unit length traversed and have an equivalent overall pressure loss relative to a reticulated member having a lower pore density but with a longer traverse length. Likewise a first reticulated member can have a pore density/traverse length characteristic that provides about the same overall pressure loss as a second reticulated member having lower pore density but a greater traverse length characteristic. The associated pore density/traverse length characteristic can be utilized to provide a desired degree of mixing at a desired pressure loss. Table 1 provides a correlation between the porosity and Reynolds Number for a natural gas/air mixture and pressure drop at peak stream velocity. Reynolds Number was calculated according to the techniques described by K. Boomsma in a dissertation entitled "Metal Foams As Novel Compact High Performance Heat Exchangers For The Cooling Of Electronics," submitted at the Swiss Federal Institute of Technology, Zurich, Switzerland on 2002.

The plurality of exit ports defines passages through which the fuel/oxidizer mixture exits and forms a plurality of corresponding streams that, upon ignition, forms a flame pattern. In accordance with one or more aspects of the invention, the plurality of ports defines constrictions or restrictions that permit controlled release of the mixture from the burner assembly. In accordance further aspects of the invention, the peripheral wall on which the ports are disposed restrict the release of the mixture from the burner assembly. For example, with reference to FIG. 4B, element 136 is encapsulated by cap 138 which comprises a plurality of ports thereby restricting exit of the mixture, during operation, from element 136 in only the openings or apertures defined by the plurality of ports 128.

TABLE 1

Reynolds Number and Pressure Loss Relative to Porosity of Porous Member.

| Foam Porosity (ppi) | Transition Reynolds Number | Port Loading (BTU/hr/in$^2$) | Peak Velocity of Air/Gas Mixture at Port Loading (m/s) | Reynolds Number at Peak Velocity | Pressure Drop at Peak Velocity (Pa) |
|---|---|---|---|---|---|
| 20 | 22.3 | 15,000 | 1.3 | 13 | 10.2 |
| 20 | 22.3 | 60,000 | 4.2 | 46 | 30.5 |
| 40 | 14.2 | 15,000 | 1.3 | 15 | 15.2 |
| 40 | 14.2 | 60,000 | 4.2 | 50 | 40.6 |

Each of the ports can be sized to provide a desired aperture area. The ports can be shaped to provide a desired flame arrangement, shape, and/or pattern upon combustion of the mixture stream exiting therefrom. The ports can be sized to provide a desired port loading and, in accordance with some aspects of the invention, provide restrictions that result in a desired maximum and/or minimum firing rate (heat flux) corresponding from a maximum and/or minimum flow velocity. For example, the burner apparatus of the invention can have a port loading that provides about 15,000 BTU/hr/in$^2$ to about 60,000 BTU/hr/in$^2$ during combustion of a fuel and oxidizer mixture such as natural gas and air. Table 2, below, provides a correlation between port loading and total port open area.

Each of the plurality of ports can be equally sized and uniformly distributed or have a uniform distribution layout. However, one or more aspects of the invention may be directed to a plurality of ports having a multiplicity of aperture areas, define at least two different areas, and, in accordance with further aspects, in a multiplicity of distribution arrangements. Other embodiments of the invention utilize ports that are not uniformly sized or have a multiplicity of shapes. One or more of the ports may be symmetrically-shaped with respect to one or more points or axes, while one or more other ports may be symmetrically-shaped with respect to one or more other points or axes.

TABLE 2

Port Loading at 12,000 BTU/hr Relative to Port Open Area.

| Open Area (in$^2$) | Port Loading at 12,000 BTU/hr (BTU/hr/in$^2$) |
|---|---|
| 0.234 | 51,000 |
| 0.292 | 41,000 |
| 0.376 | 32,000 |
| 0.298 | 40,000 |
| 0.503 | 24,000 |
| 0.398 | 30,000 |
| 0.365 | 33,000 |
| 0.539 | 22,000 |
| 0.436 | 28,000 |

As exemplarily shown in FIGS. 3A-3B, ports 128 can be uniformly disposed on peripheral wall 122 of enclosure 138, which is typically constructed to encapsulate element 136. Thus, the illustrated embodiment can restrict a mixture of fuel and oxidizer passing through element 136 into and form a corresponding plurality of exit streams directed from each of the plurality of ports 128. As further shown, the plurality of ports can be uniformly sized to provide a plurality of corresponding streams that, upon ignition/combustion thereof, provide a plurality of corresponding uniformly-shaped flames. The illustrated embodiment shown the plurality of ports disposed on a peripheral wall 122; however, one or more ports may be disposed on surface 126, at a top surface of enclosure 138, to provide, if desired one or more streams of the mixture exiting from element 136, which, upon ignition/combustion thereof, the one or more corresponding streams emanating therefrom, may contribute to a desired flame pattern.

The specific size and port loading of the ports may depend on one or more considerations including, but not limited to, the desired flame pattern, the desired maximum firing rate, the desired minimum firing rate, the pressure and flow rate of the mixture of fuel and oxidizer, the heat of combustion of the mixture, and the flashback properties of the mixture. In accordance with one or more embodiments of the invention, the ports are sized to provide stable flame combustion. Stable flame combustion conditions are created by sizing and arranging the ports to provide an exit stream of fuel/oxidizer mixture with a maximum velocity that is less than a blow off velocity. Blow off velocity occurs when a fuel/oxidizer mixture has a stream velocity greater than a flame front velocity. Stable flame combustion conditions are also present when the fuel/oxidizer stream exiting the ports has a minimum flow velocity that avoids flashback. Flashback conditions typically exist when the flame front velocity is greater than the exiting stream velocity thereby allowing the flame to propagate to the source of the fuel, e.g. the venturi assembly.

For example, the burner apparatus exemplarily illustrated in the various figures can be operated in cook top service utilizing natural gas and air as the fuel and oxidizer, respectively. For natural gas pressure of about 4 to about 5 inches of water (gauge), the burner apparatus can have eighteen uniformly distributed ports about the perimeter of the combustion section having a nominal diameter of about 50.8 mm (about 2 inches) wherein the ports have an aperture width of about 3.96 mm (about 0.156 inch) and a height of about 4.3 mm (about 0.17 inch). The ports are further exemplarily illustrated as having a curvature at an upper edge, having a radius of about 1.98 mm (about 0.078 inch). The figures exemplarily show a porous or reticulated member suitable for cooking service in residential systems with a porosity in a range from about 10 ppi to about 60 ppi and having an outer diameter of about 50.8 mm (about 2 inches), a thickness of about 12.7 mm (about 0.5 inch), and a height of about 12.7 mm (about 0.5 inch).

The various components, elements, and/or subsystems of the present inventive burner apparatus can be comprised of or fabricated from any suitable material that provides any desired physical property or desired performance. For example, any of the components of the burner apparatus can be comprised of a metal such as aluminum, steel of any suitable grade, iron such as cast or forged iron, a ceramic, or even a polymeric material or combinations, alloys, or mixtures thereof.

For example, mixing element 136 may comprise a ceramic composition, a metal, or even a metal-ceramic composite. In accordance with one or more preferred embodiments, porous member 136 can comprise steel having sufficient modulus during its service lifetime when exposed to thermal conditions associated with combustion of the plurality of proximally disposed flames emitting from the burner apparatus. In some cases, the material of construction of the element 136 has rigidity, stiffness, and/or creep resistance during operating life to serve as a structural member of the burner apparatus. For example, member or element 136 can comprise brass or stainless steel such as, but not limited to grade 316 stainless steel. However, during combustion processes, flames are not in the structure of element 136. Rather, combustion of the mixture of fuel and oxidizer occurs outside of element 136 and typically, at at least a distance defined by the thickness of a wall enclosing element 136.

EXAMPLES

The function and advantages of these and other embodiments of the invention can be further understood from the examples below, which illustrate the benefits and/or advantages of the one or more systems and techniques of the invention but do not exemplify the full scope of the invention.

Example 1

In this example, a burner apparatus as substantially shown in FIGS. 1A-2B was fabricated, characterized, and compared to commercially available burner systems. The burner apparatus comprised a FeCrAlY annular metal foam, having a porosity of about 20 ppi, an outer diameter of about 50.8 mm, an inner diameter of about 38.1 mm, and a height of about 12.7 mm, from Porvair Fuel Cell Technology, Hendersonville, N.C. The burner had 18 ports uniformly distributed about a peripheral wall thereof, which encapsulated the annular metal foam. The burner had a nominal radius of about 50.8 mm. Each of the 18 ports had a height of about 4.318 mm and a width of about 3.96 mm. The ports had a curved end having a radius of curvature of about 1.98 mm.

Natural gas and air was used as the fuel and oxidizer. The burner had a heating rate of about 11,900 BTU/hr, determined based on the pressure, flow rate, and heating value of the natural gas. The elapsed time to raise the temperature by about 69.4° C. (about 125° F.), from about room temperature (about 25° C.), of about 3.32 kg (about 7.3 pounds) of water, in an about 25.4 cm (about 10 inch) diameter pot, utilizing the burner of the invention was about 11.1 minutes, labeled on FIG. 5 as F or Foam.

For comparative purposes, other commercially available burner systems were evaluated. Table 3 lists the time required to heat the same amount of water the same temperature difference in the same pot compared to the burner of the invention. These results are also graphically presented in FIG. 5.

TABLE 3

Time to Raise Water Temperature by About 125° F. in an about 10 inch Diameter Stainless Steel Pot.

| Burner System | Burner Rating (BTU/hr) | Time to 125° F. Rise (minutes) |
|---|---|---|
| Foam Prototype F | 11,900 | 11.1 |
| GAGGENAU ™ 24 inch 4-Burner G1 | 6,000 | 22.8 |
| GAGGENAU ™ 15 inch Module G2 | 7,000 | 19.6 |
| DACOR ™ D1 | 8,500 | 15.0 |
| THERMADOR ™ 36 inch Residential T1 | 9,100 | 17.3 |
| GAGGENAU ™ 24 inch 4-Burner G3 | 10,000 | 15.0 |
| GAGGENAU ™ 15 inch Module G4 | 12,500 | 12.6 |
| DACOR ™ D2 | 12,500 | 12.4 |
| THERMADOR ™ 36 inch Residential T2 | 12,500 | 12.0 |
| DACOR ™ D3 | 14,000 | 10.2 |
| THERMADOR ™ 36 inch Pro T3 | 15,000 | 13.9 |
| WOLF ™ Pro W | 16,000 | 12.0 |

The DACOR™ burner system is available from Dacor, Inc., Diamond Bar, Calif. The THERMADOR™ and GAGGENAU™ systems are available from BSH Home Appliances Corporation, Huntington Beach, Calif. The WOLF™ system is available from the Wolf Appliance Company, LLC, Madison, Wis.

Figure 5:
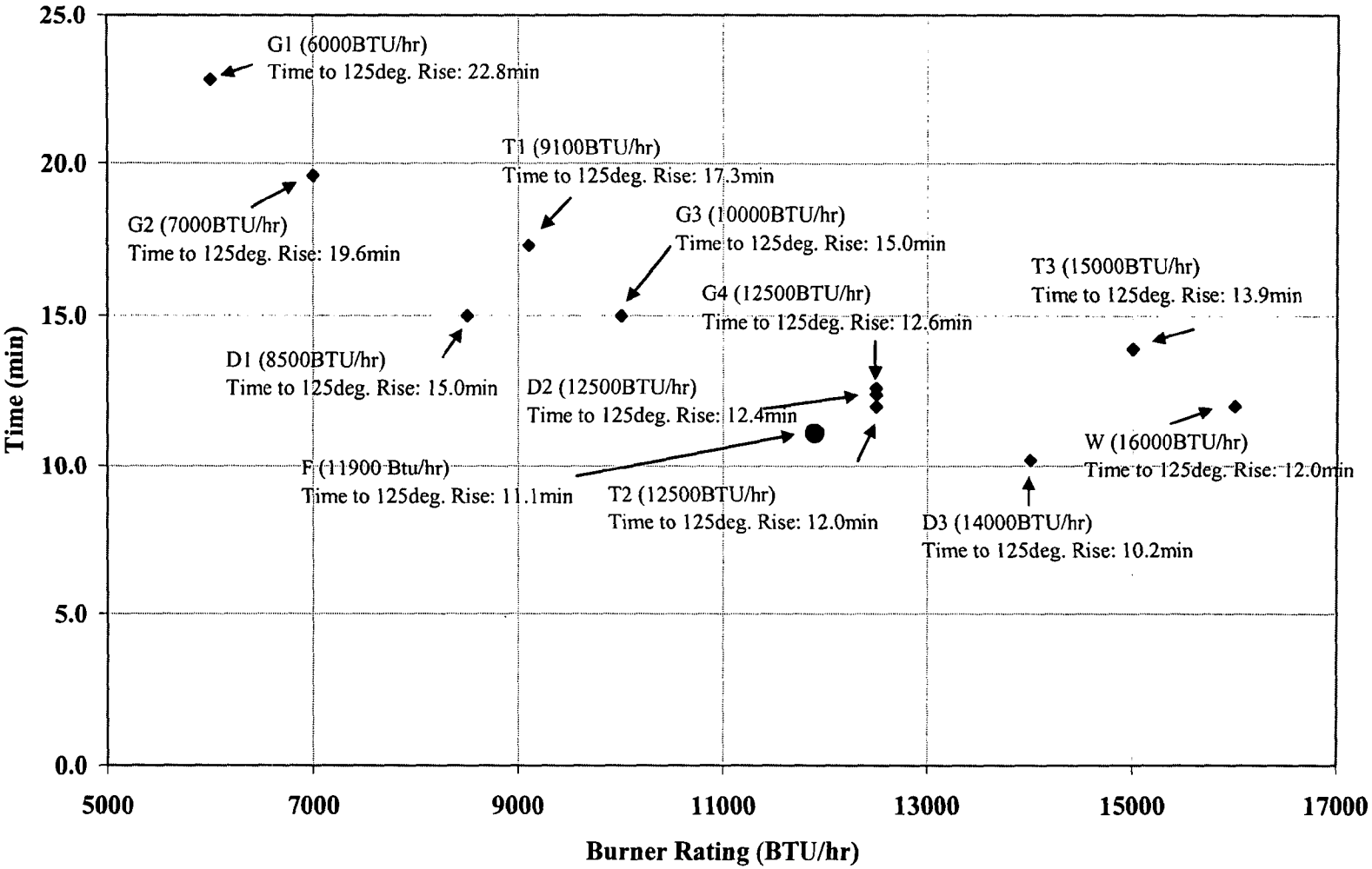
FIG. 5 is a graph showing the elapsed time (minutes) to heat about 3.3 kg (about 7.3 pounds) of water to a temperature rise of about 69.4° C. (125° F.) from room temperature utilizing various burner assemblies (with indicated firing rating, BTU/hr)

The data presented in Table 3 and FIG. 5 show that the burner apparatus of the present invention provided heating times comparable to burners having greater firing ratings.

Example 2

Figure 6:
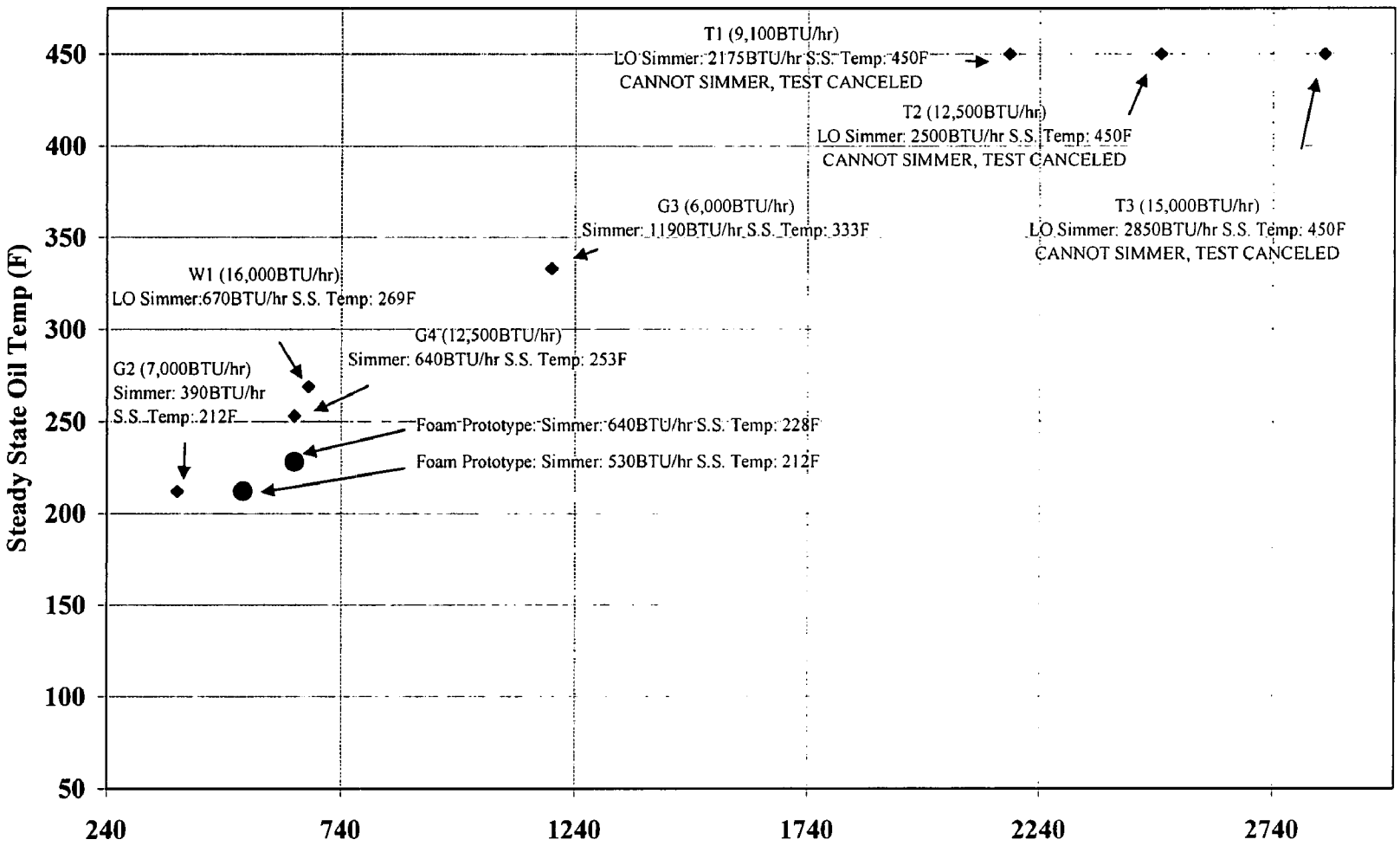
FIG. 6 is a graph showing steady state temperature (° F.) during vegetable oil simmering utilizing burner assemblies (with indicated firing rating, BTU/hr).

This example evaluates the performance during low heating rates during simmering of vegetable oil of the burner systems evaluated in Example 1. Table 4 and FIG. 6 present the measured steady state temperature (after about four to five hours) and at the lowest stable firing rate for each of the burner systems. The lowest firing rate was determined as the lowest fuel flow rate without flashback and with a self re-lighting flame.

TABLE 4

Simmering Temperature and Measured Firing Rate.

| Burner System | Burner Rating (BTU/hr) | Steady State Temperature (F.) |
|---|---|---|
| Foam Prototype F | 530 | 212 |
| GAGGENAU ™ 15 inch Mod. 7000 BTU/hr G2 | 390 | 212 |
| Foam Prototype F | 640 | 228 |
| WOLF ™ Pro 16000 BTU/hr - LO W1 | 670 | 269 |
| GAGGENAU ™ 15 inch Mod. 125000 BTU/hr G4 | 640 | 253 |
| GAGGENAU ™ 24 inch 4 Burner 6000 BTU/hr G3 | 1190 | 333 |
| THERMADOR ™ Residential 9100 BTU/hr - LO T1 | 2175 | 450 |
| THERMADOR ™ Residential 12500 BTU/hr - LO T2 | 2500 | 450 |
| THERMADOR ™ Pro 15000 BTU/hr - LO T3 | 2850 | 450 |

Example 3

The burner apparatus as substantially described in Example 1 was operated a maximum firing rate and at a minimum firing rate. The maximum firing rate was determined, based on the flow rate, pressure, and heating value of the natural gas fuel, to be about 12,700 BTU/hr. The lowest heating rate of the burner apparatus was determined to be about 680 BTU/hr. This example shows that the burner apparatus of the invention had a turndown ratio of about 18.7:1.

Example 4

In this example a commercially available burner (identified as DACOR™, unmodified), nominally rated at about 8,500 BTU/hr was evaluated and further modified.

The DACOR™ burner, available from Dacor, Inc., Diamond Bar, Calif., was first modified (labeled as DACOR™, modified) to increase the firing capacity, by enlarging the natural gas/air inlet section, to a nominal rating of about 12,500 BTU/hr.

The modified DACOR™ burner was further modified (labeled as DACOR™ with Foam) to utilize an annular metal foam having a porosity of about 20 ppi. The FeCrAlY metal foam, provided by Porvair Fuel Cell Technology, Hendersonville, N.C., had an outer diameter of about 5.87 cm (about 2 5/16 inches) and a thickness of about 4.76 mm (about 3/16 inch).

Table 5 below lists the performance of the unmodified burner compared to the modified burners. For comparison, the performance data of the Foam burner (F), evaluated in Examples 1-3, are also presented in Table 5.

Natural gas was used as the fuel and air as the oxidizer source.

The firing rates were calculated based on the pressure (corrected to standard temperature and pressure), flow rate and heating value (measured by calorimeter) of the natural gas fuel.

The Time-to-125 F. Temperature Rise evaluation was performed by measuring the elapsed time to heat about 3.32 kg of water in an about 25.4 cm diameter stainless steel pot.

The carbon monoxide emissions from each of the burners were measured according to ANSI Z21.1 with a model VIA-510 non-dispersive infrared analyzer, from Horiba Instruments, Inc., Irvine, Calif. Carbon monoxide concentration measurements were corrected to be on a dry, air-free basis, i.e., no excess air according to the formula, $$CO_{corrected}=CO_{measured}(21-O2_{reference})/(21-O2_{measured}),\text{ where } O2_{reference} \text{ is } 0.$$

The simmering temperature was determined by heating vegetable oil until a steady state temperature (after about four to five hours) was obtained at the lowest stable firing condition, i.e., the lowest fuel/air velocity with all ports having a flame that was self re-lighting, if extinguished, and without any flashback.

Efficiency was determined by comparing the theoretical amount of heat required to raise the temperature of the water against the measured heating value of the actual amount of fuel utilized to achieve the same temperature change (about 125° F.).

The turndown ratio was determined as the ratio of the maximum firing rate relative to the minimum sustainable firing rate.

TABLE 5

Performance of a Modified Available Burner.

| Burner Type | DACOR ™ unmodified | DACOR ™ modified | DACOR ™ with Foam | Foam Burner F |
|---|---|---|---|---|
| Burner Diameter (Inches) | 2.38 | 2.38 | 2.38 | 2 |
| Maximum Firing Rate (BTU/hr) | 9,270 | 13,400 | 13,150 | 11,260 |
| Time-to-125° F. Temperature Rise (minutes) | 15 | 11 | 9.8 | 13 |
| Efficiency (%) | 0.45 | 0.44 | 0.49 | 0.44 |
| High-Fire CO Emissions (Corrected ppm) | 26 | 19 | 44 | 14 |
| Minimum Sustainable Firing Rate for Simmer (BTU/hr) | 1,450 | 950 | 550 | 475 |
| Simmer Test Final Temperature (F.) | | 322 | 199 | |
| Turndown Ratio | 6.4 | 14.1 | 23.9 | 23.7 |

The data shows that a burner assembly comprising a reticulated member in accordance with the invention has improved efficiency with respect to time to heating and also provides greater flexibility by having high turndown ratios. In particular, the burner apparatus of the invention provides the flexibility to operate at lower simmering conditions (at a temperature of about 199° F.) compared to conventional burners (at about 322° F.).

The benefit under 35 U.S.C. §119 to U.S. Provisional Patent Application Ser. No. 60/559,830, entitled COOKTOP BURNER WITH IMPROVED GAS DELIVERY, filed on Apr. 6, 2004, incorporated herein by reference in its entirety, is claimed.

Having now described some embodiments of the invention, it should be apparent to those ordinarily skilled in the art that the foregoing is merely illustrative and not limiting. Indeed, numerous modifications and further aspects of the illustrative embodiments described herein are within the scope of one of ordinarily skilled in the art and are contemplated as falling within the scope of the invention. Thus, it is to be appreciated that various alterations, modifications, and improvements can readily occur to those skilled in the art and that such alterations, modifications, and improvements are intended to be part of the disclosure and within the scope of the invention. For example, optional additional features may also be utilized in the burner apparatus including, but not limited to, alignment facets that provide positive coherence during installation and/or assembly of the components of the burner apparatus. Although the examples presented herein involve specific combinations of method acts or elements, it should be understood that those acts and elements may be combined in other ways.

Further, acts, elements, and features discussed only in connection with one embodiment are not intended to be excluded from a similar role in other embodiments. For example, the present invention is also directed to modifying or retrofitting existing burner assemblies to incorporate one or more features of the burner apparatus of the invention.

Moreover, it should also be appreciated that the invention is directed to each feature, system, subsystem, or technique described herein and any combination of two or more features, systems, subsystems, or techniques described herein and any combination of two or more features, systems, subsystems, and/or methods, if such features, systems, subsystems, and techniques are not mutually inconsistent, is considered to be within the scope of the invention as embodied in the claims. Those ordinarily skilled in the art should appreciate that the parameters and configurations described herein are exemplary and that actual parameters and/or configurations will depend on the specific application in which the systems and techniques of the invention are used. Those ordinarily skilled in the art should also recognize or be able to ascertain, using no more than routine experimentation, equivalents to the specific embodiments of the invention. It is therefore to be understood that the embodiments described herein are presented by way of example only and that, within the scope of the appended claims and equivalents thereto; the invention may be practiced otherwise than as specifically described.

As used herein, the term "plurality" refers to two or more items or components. The terms "comprising," "including," "carrying," "having," "containing," and "involving," whether in the written description or the claims, are open-ended terms, i.e., to mean "including but not limited to." Use of ordinal terms such as "first," "second," "third," and the like to modify an element does not connote any priority, precedence, or order of an element over another or a temporal order in which acts are performed, but are used merely as labels to distinguish one element having a certain name from another element having a same name (but for the use of the ordinal term) to distinguish the elements.

What is claimed is:

1. A burner comprising:

means for mixing fuel and oxidizer, comprising a porous member having a plurality of random flow paths; and a peripheral wall having a plurality of exit ports disposed therein positioned downstream of the means for mixing wherein the exit ports are constructed and arranged to effect a minimum flow velocity of the mixture of fuel and oxidizer, wherein the porous member comprises an annular metal foam disposed adjacent an inner surface of the peripheral wall.

2. The burner of claim 1, wherein said porous member has a pore density in a range of about 10 pores per inch to about 60 pores per inch.

3. The burner of claim 1, wherein said plurality of exit ports define a port loading in a range of about 15,000 BTU/hr/in$^2$ to about 60,000 BTU/hr/in$^2$ during combustion of the mixture.

4. The burner of claim 1, wherein, said plurality of exit ports are sized to provide an exit stream velocity of the mixture that results in flame combustion.

5. The burner of claim 1, further comprising a venturi assembly disposed upstream of the means for mixing fluidly connecting the means for mixing and a fuel source.

6. The burner of claim 1, wherein the burner provides a maximum firing rate of at least about 12,700 BTU/hr during combustion of the mixture of fuel and oxidizer.

7. The burner of claim 6, wherein the burner provides a minimum firing rate of less than about 680 BTU/hr during combustion of the mixture of fuel and oxidizer.

8. The burner of claim 1, wherein the burner has a turndown ratio of at least about 18.7 to 1.

9. The burner of claim 1, wherein said annular metal foam has a pore density in a range of about 10 pores per inch to about 60 pores per inch.

10. The burner of claim 1, wherein the porous member is disposed in a burner cavity defined by the peripheral wall and a cap.

11. A burner apparatus comprising the burner of claim 1 disposed in a cooking appliance

12. The burner apparatus of claim 11, wherein the cooking appliance comprises a cooking utensil support assembly providing a separation distance of less than 2 inches between a heating surface of a cooking utensil and a top surface of the burner.

13. The burner apparatus of claim 11, wherein the cooking appliance does not comprise a forced air assembly.

14. A method of combustion comprising:

introducing a naturally aspirated fuel/air mixture into a burner without using forced air;

passing the fuel/air mixture through a member having a plurality of random flow paths, and a plurality of ports different from the member; and combusting the fuel/air mixture downstream of the plurality of exit ports.

15. The method of claim 14, wherein the member comprises a metal foam.

16. The method of claim 14, wherein the plurality of exit ports are disposed in a peripheral wall at least partially enclosing the member.

17. The method of claim 16, wherein the member comprises a porous ring disposed adjacent an inner surface of the peripheral wall.

18. The method of claim 14, wherein the plurality of ports are sized and spaced to provide a port loading in a range of about 15,000 BTU/hr/in$^2$ to about 60,000 BTU/hr/in$^2$ during combustion of the fuel/air mixture.

19. The method of claim 14, wherein the burner is capable of providing a maximum firing rate of at least about 12,700 BTU/hr during combustion of the fuel/air mixture.

20. The method of claim 19, wherein the burner has a nominal two-inch diameter and is capable of having a minimum firing rate of less than about 680 BTU/hr during combustion of the fuel/air mixture.

21. The method of claim 14, wherein the burner is capable of providing a minimum firing rate of less than about 680 BTU/hr during combustion of the fuel/air mixture.

22. The method of claim 14, wherein the burner is capable of providing a turndown ratio of at least about 18.7 to 1.

23. The method of claim 14, wherein the member comprises a reticulated structure.

24. The method of claim 14, wherein the burner is capable of having a Reynold's Number of greater than 13 at a peak velocity.

25. The method of claim 14, wherein the burner is capable of having a Reynold's Number of greater than 46 at a peak velocity.

26. The method of claim 14, wherein the member has a pore density in the range of about 10 pores per inch to about 60 pores per inch.

27. The method of claim 14, further comprising introducing the fuel/air mixture into a venturi assembly upstream of the member.

28. The method of claim 14, wherein the burner is disposed in a heating appliance.

29. The method of claim 14, wherein the burner is disposed in a cooking appliance.

30. The method of claim. 29, wherein the cooking appliance comprises a cooking utensil support assembly providing a separation distance of less than about 2 inches between a heating surface of a cooking utensil and a top surface of the burner.

31. The method of claim 14, wherein the burner is capable of providing a turndown ratio of least about 15 to 1.

32. The method of claim 14, further comprising inducing drawing of air into the burner.

33. The method of claim 14, wherein the burner, has a nominal two-inch diameter and is capable of having a maximum fixing rate of at least about 12,700 BTU/hr during combustion of the fuel/air mixture.

34. The method of claim 14, further comprising inhibiting or preventing flashback during combustion.

* * * * *